US009107551B2

(12) United States Patent
Kwon

(10) Patent No.: US 9,107,551 B2
(45) Date of Patent: Aug. 18, 2015

(54) VACUUM CLEANER

(75) Inventor: Hyuk-Joo Kwon, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 724 days.

(21) Appl. No.: 13/382,202

(22) PCT Filed: Jan. 18, 2010

(86) PCT No.: PCT/KR2010/000307

§ 371 (c)(1),
(2), (4) Date: Jan. 4, 2012

(87) PCT Pub. No.: WO2011/087173

PCT Pub. Date: Jul. 21, 2011

(65) Prior Publication Data

US 2012/0102671 A1 May 3, 2012

(51) Int. Cl.

| | |
|---|---|
| ***A47L 9/28*** | (2006.01) |
| ***A47L 5/22*** | (2006.01) |
| ***A47L 5/28*** | (2006.01) |
| ***A47L 5/36*** | (2006.01) |
| ***A47L 9/00*** | (2006.01) |
| ***A47L 9/10*** | (2006.01) |

(52) U.S. Cl.

CPC . *A47L 5/225* (2013.01); *A47L 5/28* (2013.01); *A47L 5/365* (2013.01); *A47L 9/0045* (2013.01); *A47L 9/108* (2013.01)

(58) Field of Classification Search

CPC ..... A47L 9/108; A47L 5/225; A47L 9/0045; A47L 5/365

USPC ..... 15/347, 352

IPC ..... A47L 9/20

See application file for complete search history.

(56) References Cited

U.S. PATENT DOCUMENTS

| | | | | |
|---|---|---|---|---|
| 8,528,163 | B2 * | 9/2013 | Park et al. | 15/352 |
| 8,544,143 | B2 * | 10/2013 | Hwang et al. | 15/352 |

FOREIGN PATENT DOCUMENTS

| | | |
|---|---|---|
| FR | 2 823 091 | 10/2002 |
| KR | 10-2009-0067309 | 6/2009 |
| KR | 10-0901027 | 6/2009 |
| KR | 10-2009-0105048 | 10/2009 |

(Continued)

OTHER PUBLICATIONS

European Search Report dated Oct. 25, 2012.

(Continued)

*Primary Examiner* — David Redding

(74) *Attorney, Agent, or Firm* — Ked & Associates, LLP

(57) ABSTRACT

Provided is a vacuum cleaner. The vacuum cleaner includes a cleaner main body, a dust container including a dust collection body separably disposed on the cleaner main body to define a dust storage chamber for storing dusts and a lower cover disposed under the dust collection body to open and close the dust storage chamber, a pressing member movably disposed inside the dust collection body to compress the dusts within the dust storage chamber, the pressing member including a rotation shaft and a pressing plate connected to the rotation shaft, a transmission part disposed under the lower cover to transmit a power transmitted from the outside, and a connection member disposed above the lower cover to transmit the power transmitted from the transmission part into the rotation shaft.

19 Claims, 13 Drawing Sheets

(56) References Cited

FOREIGN PATENT DOCUMENTS

| | | |
|---|---|---|
| WO | WO 2008/100005 | 8/2008 |
| WO | WO 2009/104878 | 8/2009 |

OTHER PUBLICATIONS

International Search Report issued in PCT Application No. PCT/KR2010/000307 dated Oct. 15, 2010.

* cited by examiner

VACUUM CLEANER

CROSS-REFERENCE TO RELATED PATENT APPLICATIONS

This application is a U.S National Stage Application under 35 U.S.C. §371 of PCT Application No. PCT/KR10/00307, filed Jan. 18, 2010, which entire disclosure is hereby incorporated by reference.

TECHNICAL FIELD

Embodiments relate to a vacuum cleaner.

BACKGROUND ART

In general, a vacuum cleaner is a device that sucks air containing dusts using a suction force generated by a suction motor mounted within a cleaner main body to filter the dusts in a dust separation device.

The vacuum cleaner includes a first suction nozzle for sucking air containing dusts, a cleaner main body communicating with the first suction nozzle, a suction motor disposed within the cleaner main body to generate an air suction force, a dust separation device in which air is introduced from the cleaner main body to separate the dusts, and a dust container in which the dusts separated in the dust separation device is stored.

Also, the dust container includes a dust collection body in which a dust storage chamber for storing the separated dusts is defined. The dusts separated in the dust separation device are stored within the dust collection body. Also, when an operation of the suction motor is stopped while the dusts are introduced into the dust collection body and stored, the separated dusts may be stored in the dust storage chamber at low density.

In the vacuum cleaner according to a related art, the dusts stored in the dust storage chamber occupy a significantly large volume with respect to its weight. Thus, it is inconvenient in that the dust container in which the dusts are stored should be frequently emptied out to maintain dust collection performance.

DISCLOSURE OF THE INVENTION

Technical Problem

Embodiments provide a vacuum cleaner in which dust collection capacity of a dust container is increased.

Embodiments also provide a vacuum cleaner in which dusts stored in a duct container are easily discharged to the outside.

Technical Solution

In one embodiment, a vacuum cleaner includes: a cleaner main body; a dust container including a dust collection body separably disposed on the cleaner main body to define a dust storage chamber for storing dusts and a lower cover disposed under the dust collection body to open and close the dust storage chamber; a pressing member movably disposed inside the dust collection body to compress the dusts within the dust storage chamber, the pressing member including a rotation shaft and a pressing plate connected to the rotation shaft; a transmission part disposed under the lower cover to transmit a power transmitted from the outside; and a connection member disposed above the lower cover to transmit the power transmitted from the transmission part into the rotation shaft.

Advantageous Effects

According to the proposed embodiments, since the dusts stored in the dust container are compressed to reduce their volume, the dusts stored in the dust container may be maximized in capacity.

Also, since the dust collection capacity of the dust container is maximized due to the compression of the dusts, the inconvenient that the dust container in which the dusts are stored is frequently emptied out may be removed.

Also, since the lower cover for opening or closing the dust storage chamber is disposed under the dust container, the dusts may be easily discharged in a state where the lower cover is rotated.

Also, since the suction tube is mounted on the main body by pushing the suction tube in a state where the second suction nozzle is mounted on the nozzle mounting part, the user's convenience may be improved.

BEST MODE FOR CARRYING OUT THE INVENTION

Hereinafter, exemplary embodiments will be described with reference to the accompanying drawings.

Figure 1:
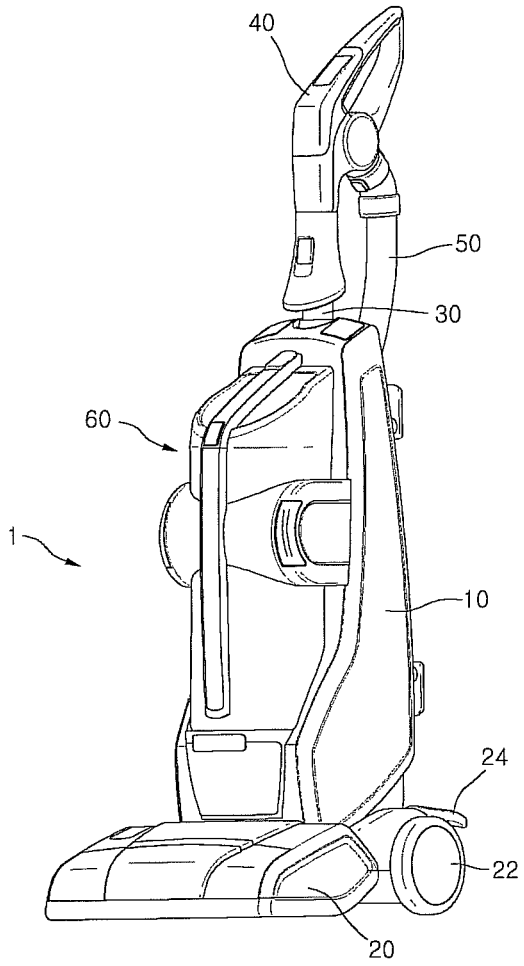
FIG. 1 is a perspective view of a vacuum cleaner according to an embodiment.
Figure 2:
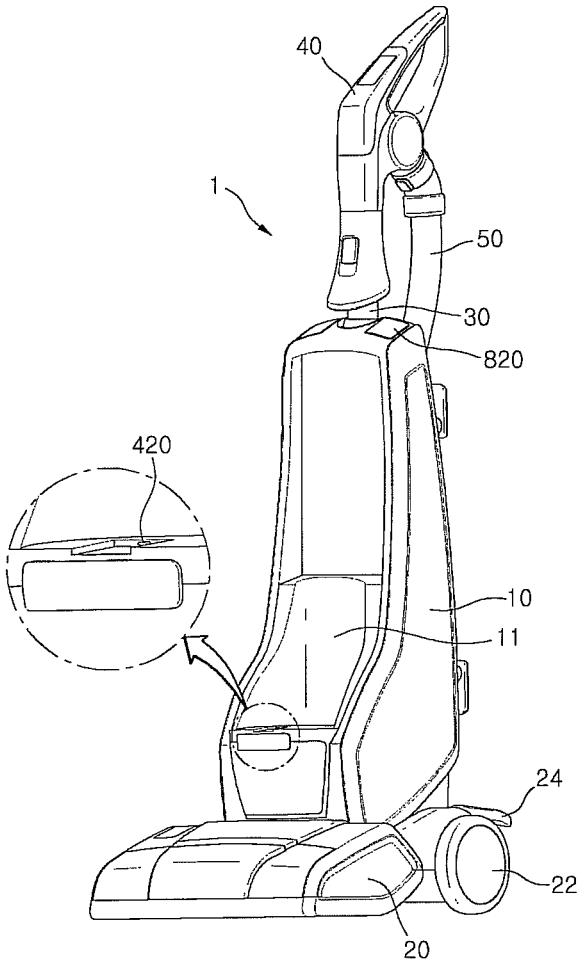
FIG. 2 is a perspective view of a vacuum cleaner from which a dust separation device is separated according to an embodiment.
Figure 3:
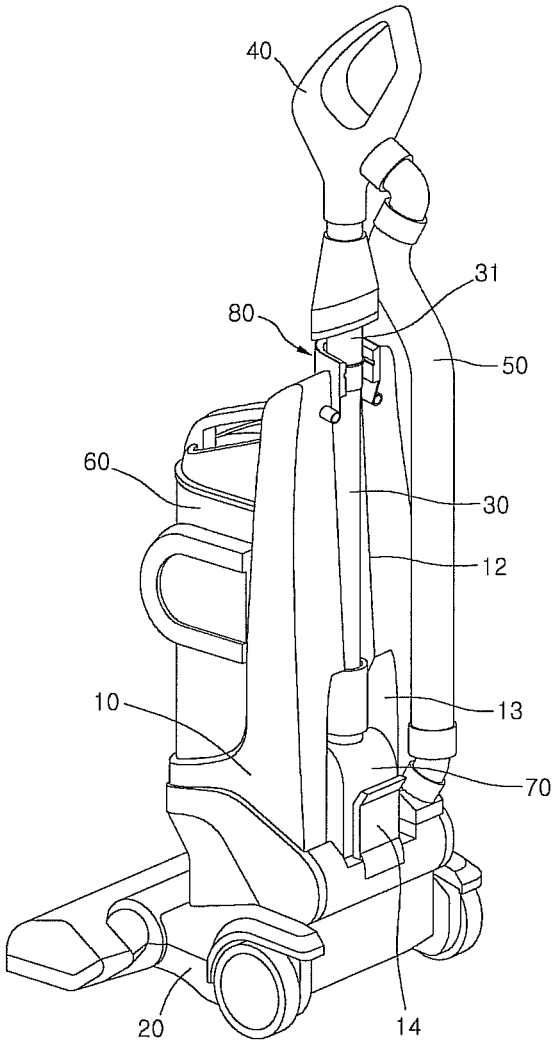
FIG. 3 is a bottom perspective view of a vacuum cleaner according to an embodiment.

FIG. 1 is a perspective view of a vacuum cleaner according to an embodiment. FIG. 2 is a perspective view of a vacuum cleaner from which a dust separation device is separated according to an embodiment. FIG. 3 is a bottom perspective view of a vacuum cleaner according to an embodiment.

Although a dust separation device is mounted on an upright-type vacuum cleaner in the current embodiment, the present disclosure is not limited thereto. For example, the dust separation device may be mounted on a canister-type vacuum cleaner.

Referring to FIGS. 1 to 3, a vacuum cleaner 1 according to the current embodiment includes a main body 10 including a suction motor (see reference numeral 520 of FIG. 9) for generating a suction force, a first suction nozzle 20 rotatably connected to a lower portion of the main body 10 and placed on a floor, a dust separation device 60 separably mounted on the main body 10, a suction tube 30 separably mounted on the main body 10, a handle 40 connected to one side of the suction tube 30, a first suction nozzle 70 connected to the other side of the suction tube 30, and a connection hose 50 connecting the handle 40 to the main body 10.

In detail, wheels 22 for easily moving the first suction nozzle 20 are disposed on both sides of the first suction nozzle 20. A manipulation lever 24 is disposed on a rear side of the first suction nozzle 20 so that the main body 10 is rotated with the first suction nozzle 20 in a state where the main body 10 stands upright. Thus, when the manipulation lever 24 is operated, the main body 10 is rotated with respect to the first suction nozzle 20. Then, a user grasps the handle 40 to clean the floor while moving the first suction nozzle 20.

The dust separation device 60 is separably mounted on a mounting part 11 disposed on a front portion of the main body 10, and the suction tube 30 is separably mounted on a rear portion of the main body 10.

A suction tube mounting part 12 for mounting the suction tube 30 and a nozzle mounting part 13 for mounting the second suction nozzle 70 are disposed on a rear portion of the main body 10. The suction tube mounting part 12 and the nozzle mounting part 13 may receive the suction tube 30 and the second suction nozzle 70. A mounting guide 14 for guiding the mounting of the second suction nozzle 70 is disposed on the main body 10. The mounting guide 14 covers the second suction nozzle 70 in a state where the second suction nozzle 70 is mounted on the nozzle mounting part 13. Thus, in a state where the second suction nozzle 70 is mounted on the nozzle mounting part 13, it may prevent the second suction nozzle 70 from being moved backward by the mounting guide 14.

In the current embodiment, the first suction nozzle may be referred to as a first suction unit, and an assembly of the second suction nozzle, the suction tube, the handle, and the connection hose may be referred to as a second suction unit.

A second coupling mechanism 80 to which a first coupling mechanism 31 is coupled is disposed on an upper portion of the main body 10. When the first coupling mechanism 31 is coupled to the second coupling mechanism 80 in a state where the second suction nozzle 70 is mounted on the nozzle mounting part 13, the suction tube 30 is fixed.

The main body 10 includes a manipulation part 820 for releasing the coupling between the first coupling mechanism 31 and the second coupling mechanism 80. Hereinafter, the first and second coupling mechanisms 31 and 80 will be described with reference to the accompanying drawing.

The dust separation device 60 may separate dusts from air sucked into the main body 10 to store the separated dusts. An operation member 420 connected to a transmission member that will be described later is disposed on the mounting part 11. The operation member 420 is rotated by a compression motor (see reference numeral 410 of FIG. 9) disposed on the main body 10. A portion of the operation member 420 is exposed to the outside of the mounting part 11. For example, a gear may be used as the operation member 420.

Since a general upright-type vacuum cleaner cleans a floor while a first suction nozzle connected to a lower portion of a main body is moved along the floor, it is difficult to clean places except the floor.

However, in the current embodiment, the second suction nozzle may be separably coupled to the main body 10 to clean spaces except the floor.

When the second suction nozzle is separated from the main body 10, the vacuum cleaner may clean the floor or portions except the floor using the second suction nozzle.

In detail, to clean the floor, the main body 10 may be rotated with respect to the first suction nozzle 20 in a state where the second suction nozzle 70 and the suction tube 30 are mounted on the main body 10. Then, the user cleans the floor while the first suction nozzle 20 is moved along the floor.

On the other hand, to clean portions except the floor, the second suction nozzle 70 and the suction tube 30 are separated from the main body 10 to suck air containing dusts using the second suction nozzle 70 in the state where the main body 10 stands upright.

Although not shown, two passages through which air flows may be provided in the main body 10 to selectively perform the cleaning using the first and second nozzles 20 and 70. Also, one of the two passages selectively communicates with the suction motor.

Hereinafter, a structure of the dust separation device 60 will be described in detail.

Figure 4:
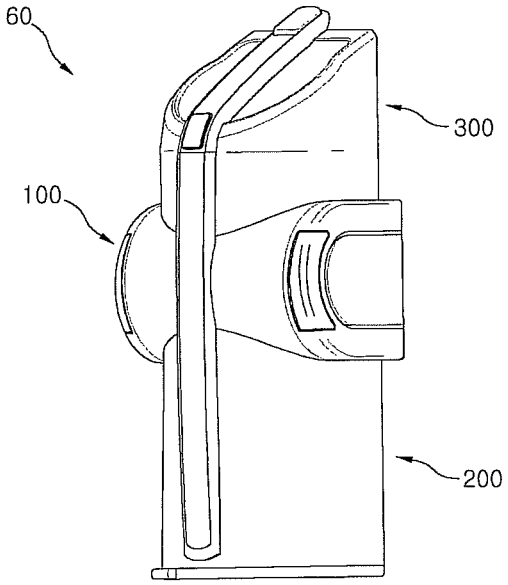
FIG. 4 is a perspective view of a dust separation device according to an embodiment.
Figure 5:
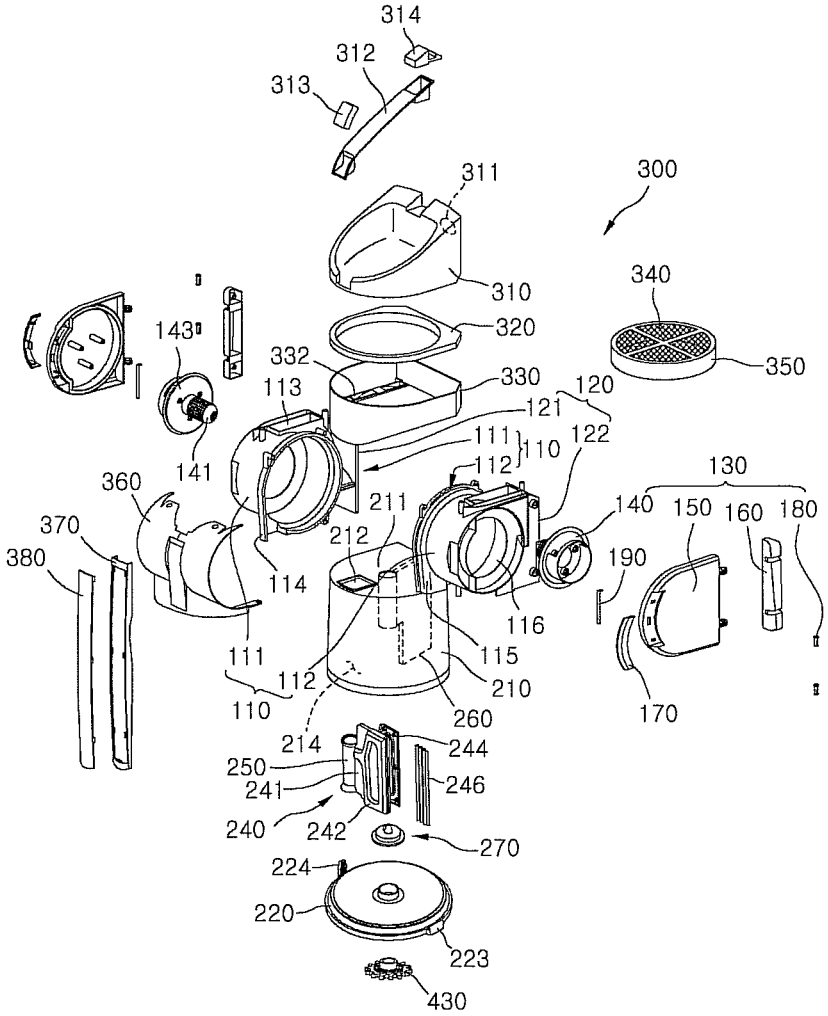
FIG. 5 is a perspective view of a dust separation device according to an embodiment.

FIG. 4 is a perspective view of a dust separation device according to an embodiment. FIG. 5 is a perspective view of a dust separation device according to an embodiment.

Referring to FIGS. 4 and 5, the dust separation device includes a dust separation unit 100 for separating dusts from sucked air, a dust container 200 for storing the dusts separated in the dust separation unit 100, a discharge guide unit 300 for guiding a flow of the air discharged from the dust separation unit 100.

The dust separation unit 100 is coupled to an upper portion of the dust container 200 and coupled to a lower portion of the discharge guide unit 300. Also, a deco cover 360 is coupled to the dust separation unit 100. An inner deco 370 and an outer deco 380 are coupled to the deco cover 360 and the dust container 200 in a state where the dust container 200 and the dust separation unit 100 are coupled to each other. The deco cover 360, the inner deco 370, and the outer deco 380 may improve beauty of the dust separation device 60.

The dust separation unit 100 includes a cyclone unit 110 for separating dusts from air, a distribution unit 120 for guiding the air and dusts into the cyclone unit 110, and a plurality of filter units movably coupled to the cyclone unit 110 to filter the air from which the dusts are separated.

A cyclone flow is generated within the cyclone unit 110. Also, the cyclone unit 110 includes a plurality of cyclone bodies 111 and 112 coupled to each other in an axis direction of the cyclone flow. The plurality of cyclone bodies 111 and 112 include a first cyclone body 111 and a second cyclone body 112 having a shape corresponding to that of the first cyclone body 111 and coupled to the first cyclone body 111. A first dust discharge part 114 is integrated with the first cyclone body 111, and a second dust discharge part 115 is integrated with the second cyclone body 112. When the first and second cyclone bodies 111 and 112 are coupled to each other, the first and second dust discharge parts 114 and 115 are coupled to each other to form a single dust discharge part. An air suction part 113 is disposed in each of the cyclone bodies 111 and 112. Thus, it may be understood that a plurality of air suction parts 113 are provided on the whole of the cyclone unit 110. Each of the air suction parts 113 may be disposed on each of both sides of the dust discharge parts 114 and 115.

The distribution unit 120 includes a first distribution unit 121 integrated with the first cyclone body 111 and a second distribution body 122 integrated with the second cyclone body 112. When the first and second cyclone bodies 111 and 112 are coupled to each other, the first and second distribution bodies 121 and 122 are coupled to each other. Also, a suction hole (not shown) is defined in one of the first and second distribution bodies 121 and 122.

An exhaust opening 116 for discharging the air from which the dusts are separated is defined in each of the cyclone bodies 111 and 112.

Each of the filter unit 130 includes a filter member 140 inserted from the outside of the cyclone unit 110 toward the inside of the cyclone unit 110, a cover member 150 coupled to the filter member 140, a cover coupling part 160 coupled to the cover member 150 to rotatably support the cover member 150, a coupling member 170 coupled to the cover member 150 and manipulated to rotate the cover member 150, an elastic member 190 elastically supporting the coupling member 170, and a shaft 180 rotatably connecting the cover member 150 to the cover coupling part 160.

The cover coupling part 160 may be coupled to the distribution unit 120. On the other hand, the cover coupling part 160 may be integrated with the distribution unit 120.

A portion of the filter member 140 is inserted into the cyclone unit through the exhaust opening 116 of the cyclone unit 110.

The dust container 200 includes a dust collection body 210 defining the dust storage chamber 214 and a lower cover 220 for opening or closing a lower side of the dust collection body 210.

For example, the dust collection body 210 may have a cylindrical shape and an opened lower side. However, the present disclosure is not limited to the shape of the duct collection body 210.

A dust inflow hole 212 through which the dusts discharged from the dust separation unit 100 are introduced is defined in a top surface 211 of the dust collection body 210. Since the dust collection body 210 is coupled to a lower portion of the dust separation unit 100 and the dust inflow hole 212 is defined in the top surface 211 of the dust collection body 210, the dusts discharged from the dust separation unit 100 may easily drop into the dust collection body 210.

The lower cover 220 has one side connected to the dust collection body 210 by a hinge 223 and the other side selectively coupled to the dust collection body 210 by a coupling hook 224. A hook part (see reference numeral 228 of FIG. 8) on which the coupling hook is hung is disposed on an outer surface of the dust collection body 210. When the lower cover 220 is rotated to open a lower side of the duct collection body 210, the dusts stored in the dust collection body 210 may be easily discharged.

A plurality of pressing members 240 and 260 for pressing the dusts stored in the dust storage chamber 214 are disposed on the dust collection body 210.

The plurality of pressing members 240 and 260 include a first pressing member 240 movably disposed on the dust storage chamber 214 and a second pressing member 260 fixed to the dust collection body 210.

The discharge guide unit 300 includes an exhaust member 330 coupled to an upper portion of the dust separation unit 100, an exhaust filter 340 seated on the exhaust member 330 to filter the exhausted air, a filter housing 350 protecting the exhaust filter 340, a filter seat guide 320 guiding the seating of the filter housing 350 coupled to the exhaust filter 340 and coupled to the exhaust member 330, and an upper cover 310 rotatably coupled to an upper portion of the exhaust member 330.

An air discharge hole 311 for discharging air is defined in the upper cover 310. The air passing through the air discharge hole 311 is moved into the main body 10.

A handle 312 to be easily grasped by the user is coupled to the upper cover 310. The handle 312 includes a first coupling button 313 for fixing a position of the upper cover 310 and a second coupling button 314 coupled to the main body 10. The first coupling button 313 is selectively coupled to the inner deco 370.

Also, an exhaust passage 332 through which the air discharged from the dust separation unit 100 flows is disposed in the exhaust member 330. The air discharged through the exhaust passage 332 passes through the exhaust filter 340 and then is discharged through the air discharge hole 311.

Hereinafter, a structure of the dust container will be described in detail.

Figure 6:
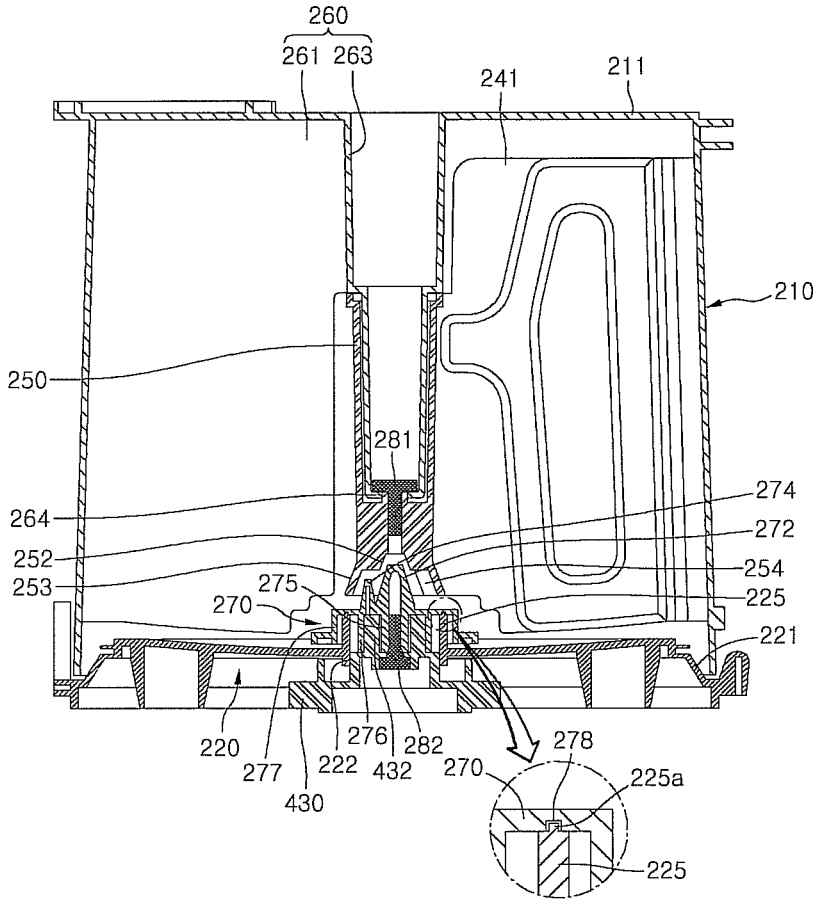
FIG. 6 is a vertical sectional view of a dust container according to an embodiment.
Figure 7:
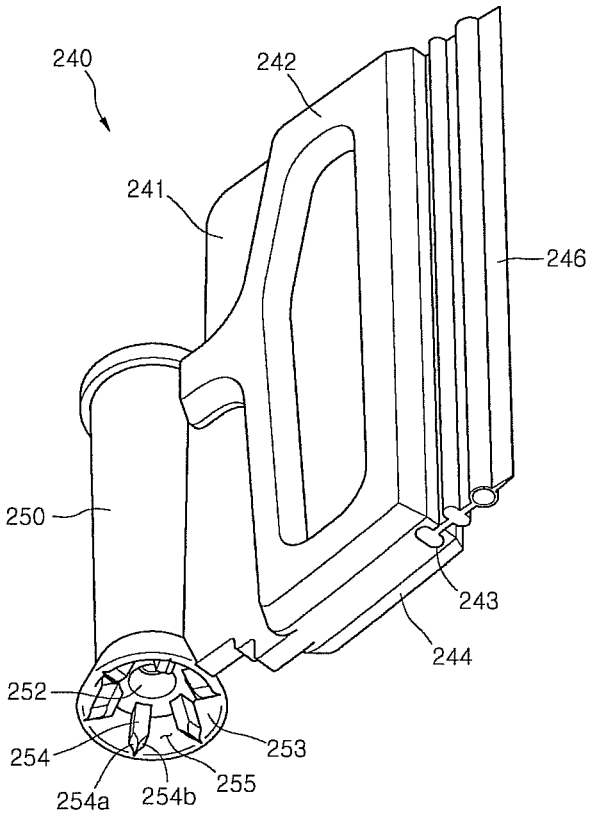
FIG. 7 is a perspective view of a first pressing member according to an embodiment.
Figure 8:
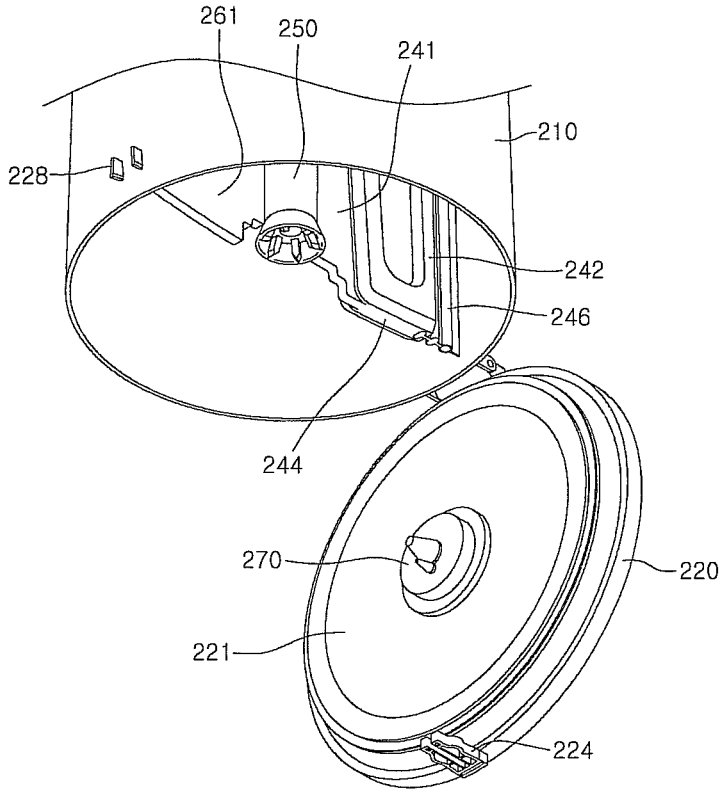
FIG. 8 is a view illustrating a state in which a lower cover opens a dust collection body according to an embodiment.

FIG. 6 is a vertical sectional view of a dust container according to an embodiment. FIG. 7 is a perspective view of a first pressing member according to an embodiment. FIG. 8 is a view illustrating a state in which a lower cover opens a dust collection body according to an embodiment.

Referring to FIGS. 1 to 8, the dust container 200 includes the dust collection body 210, the lower cover 220, the first and second pressing members 240 and 260, the transmission member 430 disposed under the lower cover 220 and selectively engaged with the operation member 420, and the connection member coupled to the transmission member above the lower cover 220 and selectively coupled to the first pressing member 240.

The first pressing member 240 includes a rotation shaft 250 and a first pressing plate 241 connected to the rotation shaft 250. The first pressing plate 241 may be integrated with the rotation shaft 250 or coupled to the rotation shaft 250.

A protrusion 242 is disposed on one surface of the first pressing plate 241 to increase a contact area with the dusts and improve strength of the first pressing plate 241. An auxiliary pressing part 244 having the same function as that of the protrusion 242 is coupled to the other surface of the first pressing plate 241. A slot 243 is defined in the first pressing plate 241 or a side surface of the protrusion 242. A cleaning member 246 for cleaning an inner surface of the dust collection body is coupled to the slot 243. The cleaning member 246 may be deformable by an external force. Also, the cleaning member 246 may be formed of a rubber material. The cleaning member 246 is rotated together with the first pressing member to clean the inner surface of the dust collection body 210. Thus, an amount of dusts attached to the inner surface of the duct collection body 210 may be minimized. As a result, the user may easily confirm the amount of dusts stored in the dust collection body 210.

The second pressing member 260 includes a fixed shaft 263 coupled to the rotation shaft 250 and a second pressing plate 261 integrated with the fixed shaft 263. The dusts stored in the dust storage chamber 214 are compressed by an interaction between the first pressing plate 241 and the second pressing plate 261. That is, the first pressing plate 241 is moved toward one side of the second pressing plate 261 to compress the dusts between the one side of the second pressing plate 261 and the first pressing plate 251. Then, the first pressing plate 241 is moved toward the other side of the second pressing plate 261 to compress the dusts between the other side of the second pressing plate 261 and the first pressing plate 241.

The fixed shaft 263 may be integrated with the top surface 211 of the dust collection body 210 or coupled to the top surface 211. The fixed shaft 263 may be a hollow shaft. Also, a portion of the fixed shaft 263 is inserted into the rotation shaft 250. In a state where the fixed shaft 263 is inserted into the rotation shaft 250, the coupling member 281 (e.g., screw) passes through the fixed shaft 263 and is coupled to the rotation shaft 250 from an upper side of the fixed shaft 263. Here, a seat end 264 on which the coupling member 281 coupled to the rotation shaft 250 is seated is disposed on the fixed shaft 263. Since the coupling member 281 is seated on the seat end 264 in a state there the coupling member 281 is coupled to the rotation shaft 250, the state in which the first pressing member 240 is coupled to the fixed shaft 263 may be maintained.

The lower cover 220 includes a bottom part 221 which is inserted into the dust collection body 210 in a state where the lower cover 220 closes a lower side of the dust collection body 210. Also, dusts or the compressed dusts are stored on a top surface of the bottom part 221.

A hole 222 through the transmission member 430 passes is defined in a center of the bottom part 221. Although the transmission member 430 passes through the hole 222 in the current embodiment, the connection member 270 may pass through the hole 222.

A support rib 225 for supporting the connection member 270 is disposed on the top surface of the bottom part 221. The support rib 225 is disposed around the hole 222. Also, the support rib 225 may be rounded so that the connection member 270 is rotated. For example, the connection member 270 may have a circular shape in horizontal section.

Also, the transmission member 430 passes through the hole 222 under the lower cover 220, and the connection member 270 is coupled to the transmission member 430 above the lower cover 220.

For example, a gear may be used as the transmission member 430. When the dust separation device 60 is mounted on the mounting part 11, the transmission member 430 is connected to the operation member 420.

An insertion part 275 is disposed on a bottom surface of the connection member 270, and a receiving part 432 for receiving the insertion part 275 is disposed in the transmission member 430. Also, in a state where the insertion part 275 is received in the receiving part 432, the coupling member 282 passes through the receiving part 432 and is coupled to the insertion part 275 under the transmission member 430. Thus, when the transmission member 430 is rotated, the connection member 270 is rotated also.

Also, a first cover part 276 surrounding the receiving part 432 of the transmission member 430 is disposed under the connection member 270. The first cover part 276 is spaced from the insertion part 275. The first cover part 276 is disposed inside the support rib 225 of the lower cover. Also, a second cover part 277 surrounding the support rib 225 is disposed under the connection member 270. The second cover part 277 is spaced outward from the first cover part 276.

A guide projection 225*a* for guiding the rotation of the connection member 270 is disposed on a top surface of the support rib 225. A guide groove 278 in which the guide projection 225*a* is inserted is defined in a bottom surface of the connection member 270. The guide groove 278 may have a circular band shape on the whole.

On the other hand, the guide projection 225*a* may be disposed on the connection member 270, and the guide groove 278 may be defined in the support rib 225.

A guider 272 connected to a central portion of the rotation shaft 250 to receive a rotation force generated in the compression motor (see reference numeral 410 of FIG. 9) is disposed on an upper central portion of the connection member 270.

Also, a second guider 274 is disposed above the connection member 270. The second guider 274 is disposed on a side of the first guider 272.

The first guider 272 may transmit the rotation force of the rotation shaft 250 and also allows a rotation center of the connection member 270 to accord with a rotation center of the rotation shaft 250. The second guider 274 may stably transmit the rotation force into the rotation shaft 250.

A first receiving part 252 for receiving the first guider 272 is recessed in a bottom surface of the rotation shaft 250. A lower rib 253 is disposed around the bottom surface of the rotation shaft 250. A plurality of hook parts 254 are disposed on inner surface of the lower rib 253. The plurality of hook parts 254 may be integrated with the bottom surface of the rotation shaft 250 and the lower rib 253. The plurality of hook parts 254 are spaced from each other. Also, a second receiving part 255 for receiving the second guider 274 is disposed between the two hook parts adjacent to each other.

A pair of inclined surfaces 254*a* and 254*b* are disposed under each of the hook parts 254 to allow the second guider 274 to be easily received into the second receiving part 255. The pair of inclined surfaces 254*a* and 254*b* gradually approaches each other downward. Thus, each of the hook parts 254 has a thickness gradually decreasing downward.

In the current embodiment, although the second receiving part is defined by the hook parts 254 disposed under the rotation shaft 250, the second receiving part may be recessed under the rotation shaft.

Referring to FIG. 6, when the lower cover 220 closes a lower side of the dust collection body 210 in a state where the suction motor is not operated, a portion of the first guider 272 is received into the first receiving part 252. That is, the first guider 272 is spaced from an inner surface of the first receiving part 252.

When the suction motor (see reference numeral 520 of FIG. 9), the bottom part 221 of the lower cover 220 may be lifted upward by a vacuum pressure to completely insert the first guider 272 into the first receiving part 252.

As described above, a reason in which the first guider 272 is spaced from the inner surface of the first receiving part 252 in a state where the lower cover 220 closes the lower side of the dust collection body 210 is for preventing a friction force between the bottom surface of the fixed shaft and the rotation shaft from being increased when the vacuum pressure is applied to the dust container.

If the first guider 272 contacts the inner surface of the first receiving part 252 in the state where the lower cover 220 closes the lower side of the dust collection body 210, when the suction motor (see reference numeral 520 of FIG. 9) is operated, the bottom part 221 should be lifted. Also, the rotation shaft 250 is lifted by the ascending of the bottom part 221.

Thus, since the rotation shaft 250 and a bottom surface of the fixed shaft 263 contact each other, a friction force between the rotation shaft 250 and the fixed shaft 263 is increased so that the first pressing member is not smoothly rotated. However, the current embodiment may solve the above-described limitations.

Figure 9:
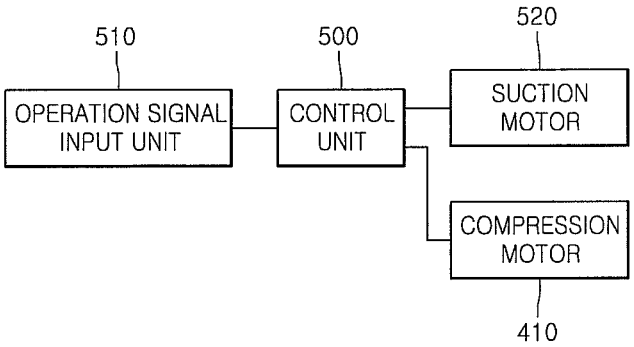
FIG. 9 is a block diagram of a vacuum cleaner according to an embodiment.

FIG. 9 is a block diagram of a vacuum cleaner according to an embodiment.

Referring to FIG. 9, the vacuum cleaner according to the current embodiment includes an operation signal input unit 510 for inputting an operation signal, a suction motor 520 for generating a suction force, a compression motor 410 for rotating the first pressing member 240, and a control unit 500 for controlling the suction motor 520 and the compression motor 410.

In detail, the compression motor 410 may be a motor that can be rotated forwardly or reversely. That is, the compression motor 410 may be a motor that can be rotated in both directions.

Thus, the first pressing member 240 may be forwardly rotated (e.g., rotated in a clockwise direction) and a reversely rotated (e.g., a counter-clockwise direction). Also, as the first pressing member 240 is forwardly and reversely rotated, the compressed dusts may be accumulated on both sides of the second pressing member 260.

A synchronous motor may be used as the compression motor 410 so that the compression motor 410 is forwardly and reversely rotatable. The synchronous motor may be forwardly and reversely rotated itself. For example, in a case where the motor is rotated in one direction, when a force applied to the motor is above a set value, the motor may be rotated in the other direction.

Figure 10:
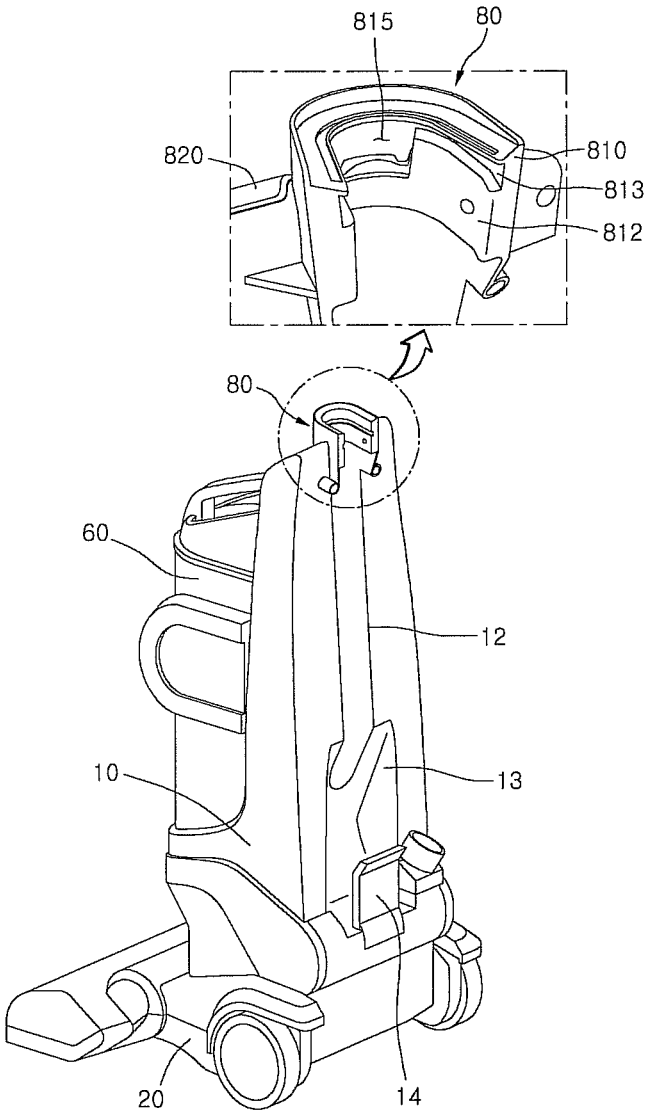
FIG. 10 is a bottom perspective view of a main body in a state where a suction tube and a suction nozzle are separated from each other.
Figure 11:
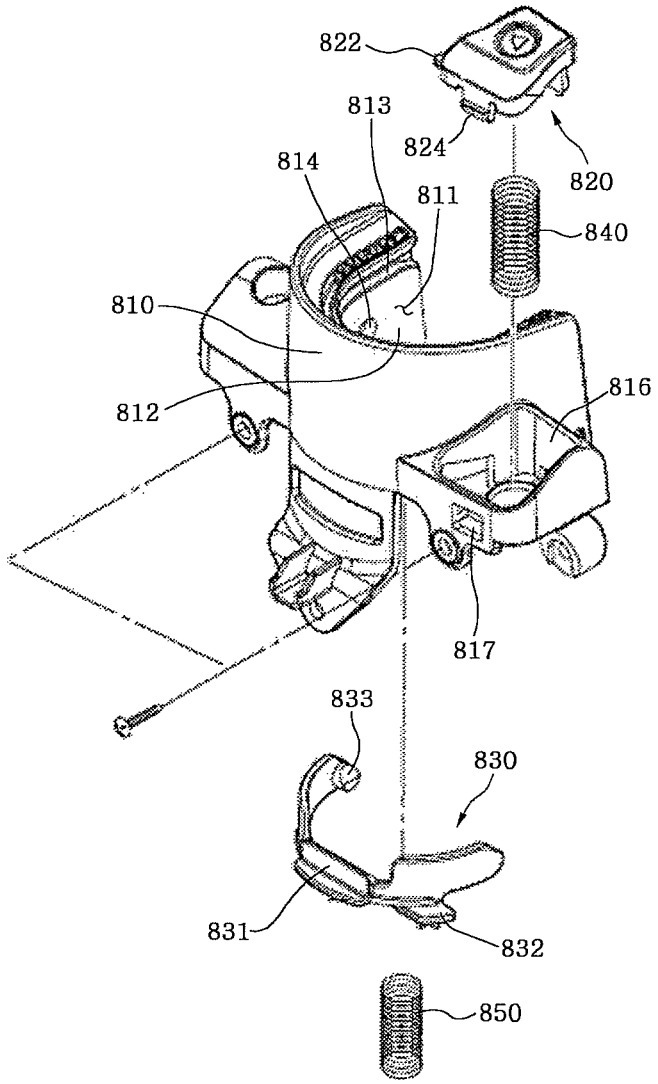
FIG. 11 is an exploded perspective view of a second coupling mechanism according to an embodiment.
Figure 12:
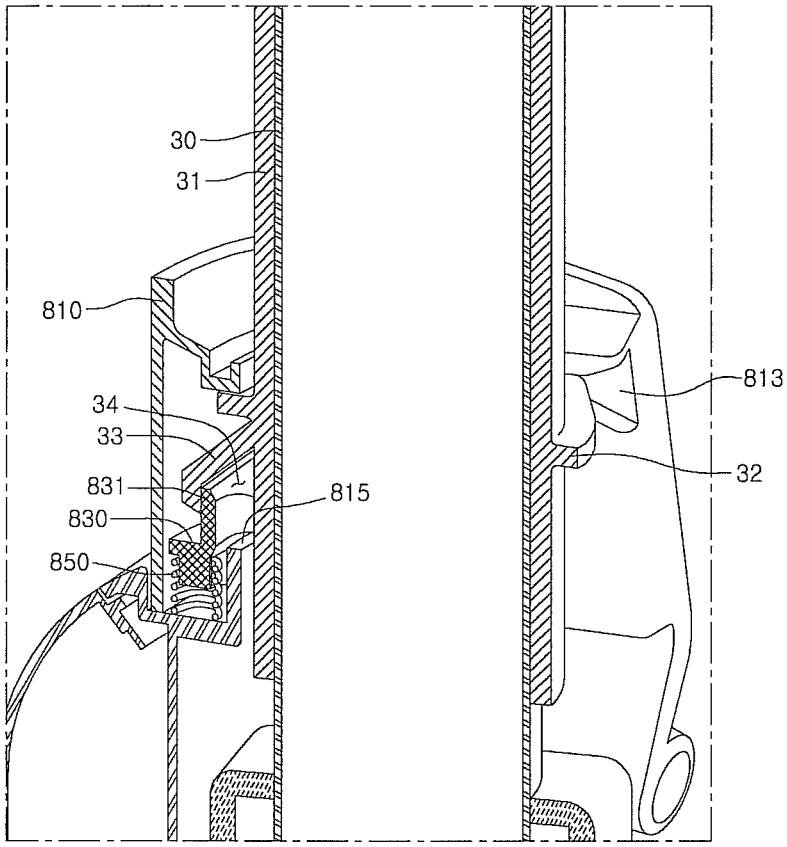
FIG. 12 is a sectional view of a state in which first and second coupling mechanisms are coupled to each other according to an embodiment.

FIG. 10 is a bottom perspective view of a main body in a state where a suction tube and a suction nozzle are separated. FIG. 11 is an exploded perspective view of a second coupling mechanism according to an embodiment. FIG. 12 is a sectional view of a state in which first and second coupling mechanisms are coupled to each other according to an embodiment.

Referring to FIGS. 1, and 10 to 12, the first coupling mechanism surrounds the outside of the suction tube 30. The first coupling mechanism 31 includes a guide rib 32 for guiding the coupling between the first coupling mechanism 31 and the second coupling mechanism 80. The guide rib 32 is disposed along a circumference of the first coupling mechanism 31.

Also, the first coupling mechanism 31 includes a first coupling part 33. The first coupling part 33 defines a space 34 in which a second coupling part that will be described later is inserted.

The second coupling mechanism 80 includes a housing 810, a manipulation part 820, and a second coupling part 830.

The housing 810 is coupled to an upper portion of the main body 10 to define a receiving space 811 for receiving a portion of the suction tube 30 (or the first coupling mechanism). The housing 810 is disposed above the suction tube mounting part 12.

A rib receiving part 813 in which the guide rib 32 is received is recessed in a wall 812 defining the receiving space 811. The rib receiving part 813 may be defined in the wall 812 in front and rear directions. Also, an opening 815 through which the first coupling part 33 passes is defined in the wall 812.

A mounting part 816 for mounting the manipulation part 820 is disposed on the housing 810. A hole 817 coupled to the manipulation part 820 is defined in the mounting part 816.

The manipulation part 820 is a portion to be manipulated by a user to release the coupling between the first coupling mechanism 31 and the second coupling mechanism 80. A hook 824 coupled to the hole 817 is disposed on the manipulation part 820. Also, the manipulation part 820 is supported by a first elastic member 840 in a state where the manipulation part 820 is mounted on the mounting part 816. The first elastic member 840 supports a bottom surface of the manipulation part 820 in a state where the first elastic member 840 is seated on the mounting part 816.

Also, a push part 822 for selectively pushing the second coupling part 830 is disposed on the manipulation part 820.

The second coupling part 830 is disposed within the housing 810. The second coupling part 830 is rotatably connected to the housing 810. A plurality of coupling projections 833 coupled to the housing 810 are disposed on the coupling part 830. Also, a plurality of coupling holes 814 in which the plurality of coupling projections 833 are inserted are defined in the housing 810.

A hook part 831 is disposed on a central portion of the second coupling part 830 and thus selectively hooked on the first coupling part 33. The hook part 831 is hooked on the first coupling part 33 in a state where the hook part 831 is received into the space defined by the first coupling part 33.

The second coupling part 830 includes a laying part 832 on which the push part 822 is laid. When the push part 822 laid on the laying part 832 pushes the laying part 832, the second coupling part 830 is moved downward to release the coupling between the first and second coupling parts 33 and 830. Also, the second coupling part 830 is elastically supported by the second elastic member 850.

Figure 13:
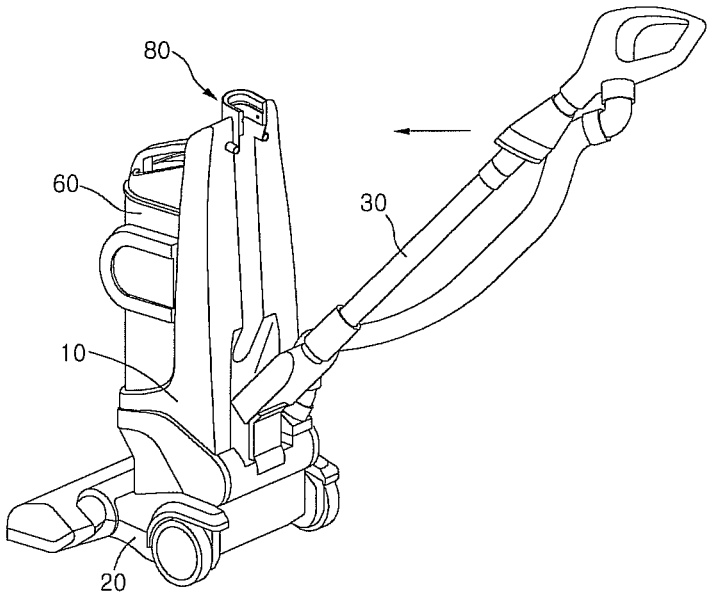
FIG. 13 is a view of a state in which a suction tube connected to a second suction nozzle is being mounted on a main body.

FIG. 13 is a view of a state in which a suction tube connected to a second suction nozzle is being mounted on a main body.

Referring to FIGS. 10 to 13, to mount the suction tube 30 on the main body 10, firstly, the second suction nozzle 70 is mounted on the nozzle mounting part 13. In a state where the second suction nozzle 70 is mounted on the nozzle mounting part 13, the suction tube 30 is pushed toward the main body 10.

As a result, the guide rib 32 is inserted into the rib receiving part 813 to guide the reception into the housing 810 of the suction tube 30. When the suction tube 30 is received into the housing 810, the first coupling part 33 passes through the opening 815. The first coupling part 33 passing through the opening 815 may pass over the hook part 831 while pushing the hook part 831. When the hook part 831 is pushed, the second coupling part 830 is moved downward.

When the suction tube 30 is completely received into the housing 810, the force pushing the hook part 831 is removed. Thus, the second coupling part 830 is moved upward by the second elastic member 850. As a result, the hook end 831 is hooked on the first coupling part 33, and the first coupling mechanism 31 is coupled to the second coupling mechanism 80. When the first and second coupling mechanisms 31 and 80 are coupled to each other, it may prevent the suction tube 30 from being separated from the main body 10 and from being moved in front and rear direction of the main body 10.

To separate the suction tube 30 from the main body 10, the manipulation part 820 is pushed. Thus, the manipulation part 820 is moved downward to push the second coupling part 830. Also, the second coupling part 830 is moved downward to release the coupling between the second coupling part 830 and the first coupling part 33. Then, when the suction tube 30 is pulled toward a rear side of the main body 10, the suction tube 10 is separated from the main body 10.

In the current embodiment, the suction tube 30 is mounted (coupled) to the main body 10 in the front and rear directions of the main body 10. That is, since the suction tube 30 is mounted on the main body 10 by pushing the suction tube 30 in a state where the second suction nozzle 70 is mounted on the nozzle mounting part 13, user's convenience may be improved.

Hereinafter, an operation of the vacuum cleaner will be described.

When an ON signal of the vacuum cleaner is inputted through the operation signal input unit 510, the suction motor 520 is operated. When the suction motor 250 is operated, dusts and air are sucked through the first suction nozzle 20 by the suction force of the suction motor 250. Then, the air sucked through the first suction nozzle 20 is introduced into the main body 10. The air introduced into the main body 10 is moved into the dust separation unit 100 and then separated from the dusts in the dust separation unit 100. The dusts separated from the air are stored in the dust container 200. On the other hand, the air separated from the dusts are introduced again into the main body 10 via the discharge guide unit.

As described above, when the dusts contained in the air are separated and stored in the dust container 200, the plurality of pressing members 240 and 260 compress the dusts stored in the dust container 200 through the interaction therebetween.

The control unit 500 operates the compression motor 410 to compress the dusts stored in the dust container 200 after the suction motor 520 is operated or at the same time when the suction motor 520 is operated.

When the compression motor 410 is operated, the operation member 420 coupled to the compression motor 410 is rotated. Then, when the operation member 420 is rotated, the transmission member connected to the operation member 420 is rotated. When the transmission member 430 is rotated, the connection member 270 is rotated together.

As the rotation shaft 250 of the connection member 270 is rotated, the first pressing plate 241 compresses the dusts while being rotated toward one side of the second pressing plate. Also, when the force applied to the compression motor 410 is above the set value, the compression motor is reversely rotated. Thus, the first pressing plate 241 compresses the dusts while being rotated toward the other side of the second pressing plate 261.

During the operation of the suction motor and the compression motor, when an OFF signal of the vacuum cleaner is inputted through the operation signal input unit 510, the control unit 500 controls the suction motor 520 and the compression motor 410 to turn off.

To empty the dust container containing the dusts, the dust separation device is separated from the main body. Then, the lower cover is rotated to open the lower side of the dust container. Thus, the dusts stored in the dust container may drop down.

According to the current embodiment, since the dusts stored in the dust container are compressed by the interaction between the first and second pressing members 240 and 260, an amount of dusts stored in the dust container may be maximized.

Also, since the first and second pressing members are disposed on the duct collection body in a state where the lower cover opens the lower side of the duct collection body, the dusts stored in the duct collection body may be easily discharged to the outside.

Although the dust container together with the dust separation unit is separated from the main body in the current embodiment, the dust container and the dust separation unit may be individually separated from the main body.

The invention claimed is:

1. A vacuum cleaner comprising:

a cleaner main body;

a dust container comprising a dust collection body separably disposed on the cleaner main body to define a dust storage chamber for storing dust and a lower cover disposed under the dust collection body to open and close the dust storage chamber;

a pressing member movably disposed inside the dust collection body to compress the dust within the dust storage chamber, the pressing member comprising a rotation shaft and a pressing plate connected to the rotation shaft;

a transmission part disposed under the lower cover to transmit a power transmitted from the outside; and a connection member disposed above the lower cover to transmit the power transmitted from the transmission part into the rotation shaft, wherein the connection member comprises a first guider disposed on a central portion of the connection member and a second guider disposed on a side of the first guider.

2. The vacuum cleaner according to claim 1, wherein a height of the first guider is different from a height of the second guider.

3. The vacuum cleaner according to claim 2, wherein the rotation shaft comprises first and second receiving parts for respectively receiving the first and second guiders.

4. The vacuum cleaner according to claim 3, wherein a plurality of hook parts spaced from each other to define the second receiving part is disposed on a bottom surface of the rotation shaft.

5. The vacuum cleaner according to claim 1, further comprising a coupling member for coupling the transmission part to the connection member.

6. The vacuum cleaner according to claim 1, wherein the lower cover comprises a hole through which the connection member or the transmission part passes and a support rib for supporting the connection member.

7. The vacuum cleaner according to claim 6, wherein a guide projection is disposed on one of the support rib and the connection member to guide rotation of the connection member and a guide groove in which the guide projection is inserted is defined in the other one of the support rib and the connection member.

8. The vacuum cleaner according to claim 1, wherein a protrusion for increasing a contact area with the dust is disposed on the pressing plate.

9. The vacuum cleaner according to claim 1, wherein an auxiliary pressing part for increasing a contact area with the dust is disposed on the pressing plate.

10. The vacuum cleaner according to claim 1, wherein a cleaning member contacting an inner surface of the dust collection body to clean the inner surface of the dust collection body is disposed on a side surface of the pressing member.

11. A vacuum cleaner comprising:

a cleaner main body;

a dust container comprising a dust collection body separably disposed on the cleaner main body to define a dust storage chamber for storing dust and a lower cover disposed under the dust collection body to open and close the dust storage chamber;

a pressing member movably disposed inside the dust collection body to compress the dust within the dust storage chamber, the pressing member comprising a rotation shaft and a pressing plate connected to the rotation shaft;

a transmission part disposed under the lower cover to transmit a power transmitted from the outside; and a connection member disposed above the lower cover to transmit the power transmitted from the transmission part into the rotation shaft, wherein the lower cover comprising a support rib to support the connection member, wherein a guide projection is disposed on one of the support rib and the connection member to guide rotation of the connection member and a guide groove in which the guide projection is inserted is defined in the other one of the support rib and the connection member.

12. The vacuum cleaner according to claim 11, wherein the rotation shaft comprises first and second receiving parts for respectively receiving the connection member.

13. The vacuum cleaner according to claim 12, wherein a plurality of hook parts spaced from each other to define the second receiving part is disposed on a bottom surface of the rotation shaft.

14. The vacuum cleaner according to claim 11, further comprising a coupling member for coupling the transmission part to the connection member.

15. The vacuum cleaner according to claim 11, wherein the lower cover includes a hole through which the connection member or the transmission part passes and a support rib for supporting the connection member.

16. A vacuum cleaner comprising:

a cleaner main body;

a dust container having a dust storage chamber for storing dust and a lower cover provided under the dust collection body to open and close the dust storage chamber;

a pressing plate connected to a rotation shaft inside the dust container to compress the dust within the dust storage chamber a gear provided under the lower cover to transmit a power transmitted from the outside; and a coupler provided over the lower cover to be inside the dust storage chamber when the lower cover is closed, and the coupler is rotatable above the lower cover to transmit the power transmitted from the gear to the rotation shaft, wherein the lower cover includes an opening and the gear protrudes through the opening to connect to the coupler.

17. The vacuum cleaner of claim 16, wherein a cleaning blade is coupled to a side surface of the pressing plate to clean an inner surface of the dust container.

18. The vacuum cleaner of claim 16, wherein the coupler comprises a first protrusion and a second protrusion provided adjacent to the first protrusion.

19. The vacuum cleaner of claim 18, wherein the first and second protrusions are cone-shaped.

* * * * *